US006572153B2

(12) United States Patent
Tatsuta et al.

(10) Patent No.: US 6,572,153 B2
(45) Date of Patent: Jun. 3, 2003

(54) STRUCTURE FOR MOUNTING TUBES TO HEADER MEMBER OF A HEAT EXCHANGER

(75) Inventors: Koji Tatsuta, Tokyo (JP); Kenji Shimizu, Tokyo (JP); Shizuo Matsumoto, Tokyo (JP)

(73) Assignee: Calsonic Kansei Corporation, Tokyo (JP)

( * ) Notice: Subject to any disclaimer, the term of this patent is extended or adjusted under 35 U.S.C. 154(b) by 0 days.

(21) Appl. No.: 09/511,094

(22) Filed: Feb. 23, 2000

(65) Prior Publication Data

US 2002/0149202 A1 Oct. 17, 2002

(30) Foreign Application Priority Data

Feb. 23, 1999 (JP) ..... 11-044875
Feb. 1, 2000 (JP) ..... 2000-023925

(51) Int. Cl.[7] ..... F16L 41/00
(52) U.S. Cl. ..... 285/222; 285/382.4; 165/178
(58) Field of Search ..... 285/214, 222, 285/382, 382.4; 29/890.038, 890.044, 890.052; 165/173, 178; 138/DIG. 11

(56) References Cited

U.S. PATENT DOCUMENTS

| | | | | | |
|---|---|---|---|---|---|
| 341,554 | A | * | 5/1886 | Cobb | 285/222 X |
| 685,866 | A | * | 11/1901 | Reagan | 285/222 |
| 1,500,560 | A | * | 7/1924 | Henderson | 285/222 |
| 1,502,301 | A | | 7/1924 | Fedders | |
| 1,719,847 | A | * | 7/1929 | Morse | 29/890.044 |
| 3,940,837 | A | * | 3/1976 | Wiese | 285/222 X |
| 3,964,873 | A | * | 6/1976 | Aramaki et al. | 165/178 X |
| 4,369,837 | A | * | 1/1983 | Moranne | 195/178 X |
| 5,709,028 | A | | 1/1998 | Kreutzer et al. | |
| 5,787,973 | A | * | 8/1998 | Kado et al. | 165/178 X |
| 6,263,570 | B1 | * | 7/2001 | Cazacu | 285/222 X |
| 6,460,610 | B2 | * | 10/2002 | Lambert et al. | 165/173 X |

FOREIGN PATENT DOCUMENTS

| | | |
|---|---|---|
| DE | 40 26 988 | 2/1992 |
| GB | 560205 | 3/1944 |
| GB | 822092 | 10/1959 |
| GB | 2 003 762 | 3/1979 |
| GB | 2 075 173 | 11/1981 |
| JP | 60-49861 | 3/1985 |

* cited by examiner

*Primary Examiner*—Greg Binda
(74) *Attorney, Agent, or Firm*—Foley & Lardner

(57) ABSTRACT

A structure for mounting a tube to a header member of heat exchanger is such that the header member has a tube hole and the tube is disposed through the tube hole so that a portion of the tube projects out of and beyond the header member. The portion of the tube which projects outwardly is expanded via the insertion of an expansion wedge to establish a tight contact between the tube and the tube hole.

7 Claims, 9 Drawing Sheets

11
13a
11b
11c
11d
11a
P1
19
21
13
15
17
P
A
A'
D
1.5
1.5

STRUCTURE FOR MOUNTING TUBES TO HEADER MEMBER OF A HEAT EXCHANGER

BACKGROUND OF THE INVENTION

1. Field of the Invention

The present invention relates to an expansion wedge for use with a heat exchanger tube which expands the diameter of an opening of a flat tube to be inserted into a tube hole formed in a header member and which brings the opening into close contact with the tube hole, as well as a structure for mounting a tube to a header member of the heat exchanger manufactured through use of the expansion wedge.

The present application is based on Japanese Patent Applications No. Hei. 11-44875 and 2000-23925, which are incorporated herein by reference.

2. Description of the Related Art

According to a known method of manufacturing a heat exchanger, such as a radiator, an opening of a flat tube is expanded while the tube remains inserted into a tube hole formed in a header member, thereby bringing the opening into close contact with the tube hole. Methods described in: for example, Japanese Patent Publication Nos. Sho. 59-180295 and Sho. 60-49861, have already been known as manufacturing methods of this type.

FIG. 14 shows a manufacturing method described in Japanese Patent Publication No. Sho. 60-49861. According to this method, a core section 4 is interposed between header members 1 spaced apart from each other by a given distance so as to be mutually oppose. The core section 4 is assembled by alternating arrangement of tubes 2 and corrugated fins 3.

Respective ends of the tubes 2 are inserted into corresponding tube holes 1*a* formed in the header member 1. Expansion wedges 6 formed on each of jigs 5 disposed on opposite sides of the core section 4 are inserted into openings 2*a* of the tubes 2, thereby bringing the openings 2*a* into close contact with the tube holes 1*a*.

Under such a manufacturing method, the openings 2*a* of the tubes 2 are brought into close contact with the tubes holes 1*a*, thereby preventing falling of the header members 1 and abating a solder running failure, which would otherwise frequently arise during a brazing process in a subsequent step.

Under such a known manufacturing method, a portion of the edge of the opening 2*a* of the tube 2 expanded by the expansion protrusion 6 becomes collapsed, as shown in FIG. 15, thus frequently inducing formation of a collapsed portion 2*b*.

In the event that the tube 2 becomes partially collapsed, coolant circulating through the tube 2 leaks out from the collapsed portion. For this reason, inspection for collapsed portions requires scrupulous attention and a large number of steps.

Considerable research conducted by the present inventor for solving the drawback of the known manufacturing methods shows that, as shown in FIG. 16, a longitudinal side surface 2*c* of the tube 2 becomes inwardly deformed during transportation of the tube 2, introduction of the tubes 2 into an assembly facility, or assembly of the core section 4 and that, if the expansion protrusion 6 is inserted into the opening 2*a* in this state, the expansion protrusion 6 comes into collision with the longitudinal side surface 2*c*,thus inducing formation of the collapsed portion 2*b*.

It is also found that, even when the longitudinal side surface 2*c* becomes deformed, as shown in FIG. 16, spaces 2*d* remain present in opposite ends of the flat tube 2.

SUMMARY OF THE INVENTION

The present invention has been conceived on the basis of the previously-described finding and is aimed at providing an expansion wedge for use with a heat exchanger tube which can readily and thoroughly prevent collapse of an opening of a tube, as well as a structure for mounting a tube to a header member in a heat exchanger manufactured through use of the expansion wedge.

Accordingly, the present invention provides an expansion wedge for use with a heat exchanger tube which increases the cross-sectional width of an opening of a flat tube inserted into a tube hole of a header member through use of an expansion section to be inserted into the opening and which brings the opening into close contact with the tube hole, the expansion wedge comprising: an expansion wedge body on which there is formed the expansion section for expanding the distance between longitudinal side surfaces of the tube when being inserted a predetermined depth into the opening of the tube, and guide protuberances which are protrusively formed on the respective longitudinal sides of the expansion section and which are inserted into the spaces provided on the respective sides of the opening of the tube, thereby guiding the expansion section into the opening.

Further, the present invention provides a structure for mounting a tube to a header member of a heat exchanger, by means of inserting an opening of a flat tube into a tube hole of a header member, wherein either longitudinal side of the opening of the tube is made so as to have a width greater than that of a center portion, and the opening is brought into press-contact with the tube hole of the header member.

In the expansion wedge of the present invention, the guide protuberances formed at the respective longitudinal sides of the expansion section are inserted into the spaces provided on the respective sides of the opening of the tube, thereby guiding the expansion section into the opening.

The expansion section is inserted into the opening, thereby increasing the distance between the longitudinal sides of the opening of the tube. As a result, the opening is brought into close contact with the tube hole.

In the structure for mounting a tube to a header member, either longitudinal side of the opening of the tube is made so as to have a width greater than that of a center portion, and the respective longitudinal sides of the opening are brought into press-contact with the tube hole of the header member.

Features and advantages of the invention will be evident from the following detailed description of the preferred embodiments described in conjunction with the attached drawings.

Another aspect of the invention resides in a structure for mounting a flat tube to a header member of a heat exchanger, comprising: a tube hole formed in the header member; and an opening of the flat tube being inserted into the tube hole, the opening of the flat tube having longitudinally opposed end sections and a center section which is located between the end sections, wherein the opening of the flat tube is expanded in such a manner that both longitudinally opposed end sections of the opening of the flat tube have opposed sides which have a width greater than any widths of opposed sides of the center portion of the opening of the flat tube, so that at least the opposed sides of the end sections of the opening of the flat tube are brought into press-contact with the header member around the tube hole.

DETAILED DESCRIPTION OF THE PREFERRED EMBODIMENTS

The present invention will be described in detail hereinbelow by reference to embodiments shown in the accompanying drawings.

Figure 1:
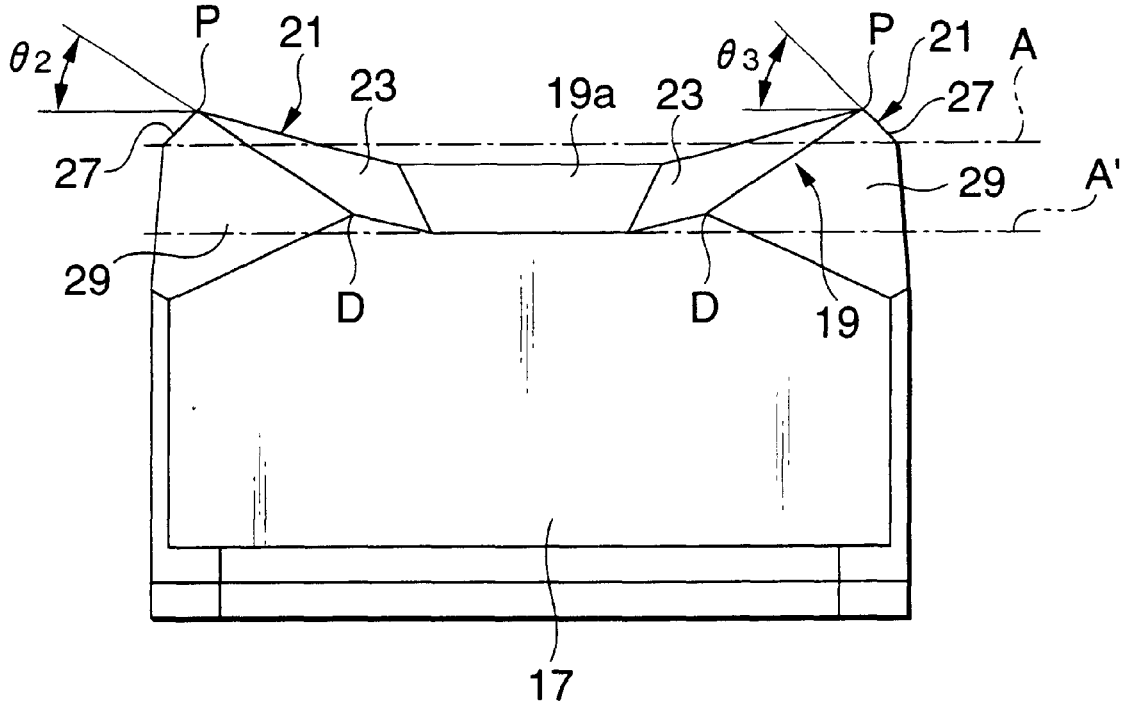
FIG. 1 is a side view showing an expansion wedge for use with a heat exchanger tube according to a first embodiment of the present invention.
Figure 2:
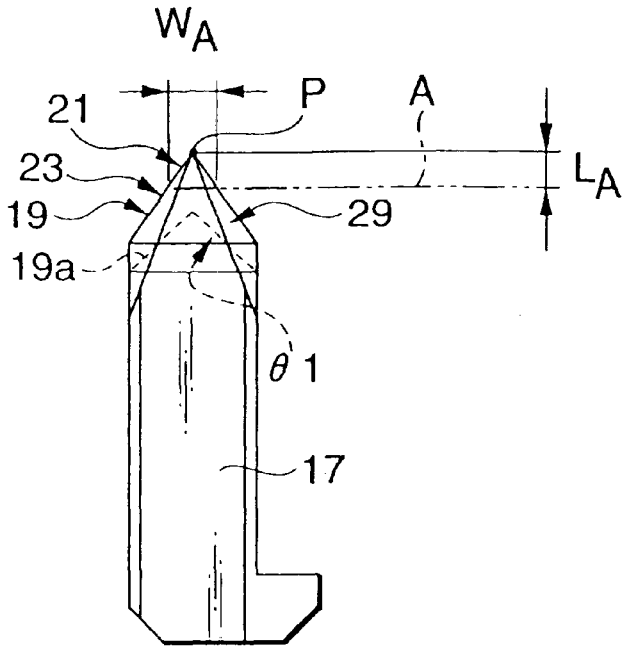
FIG. 2 is a front view of the expansion wedge shown in FIG. 1.
Figure 3:
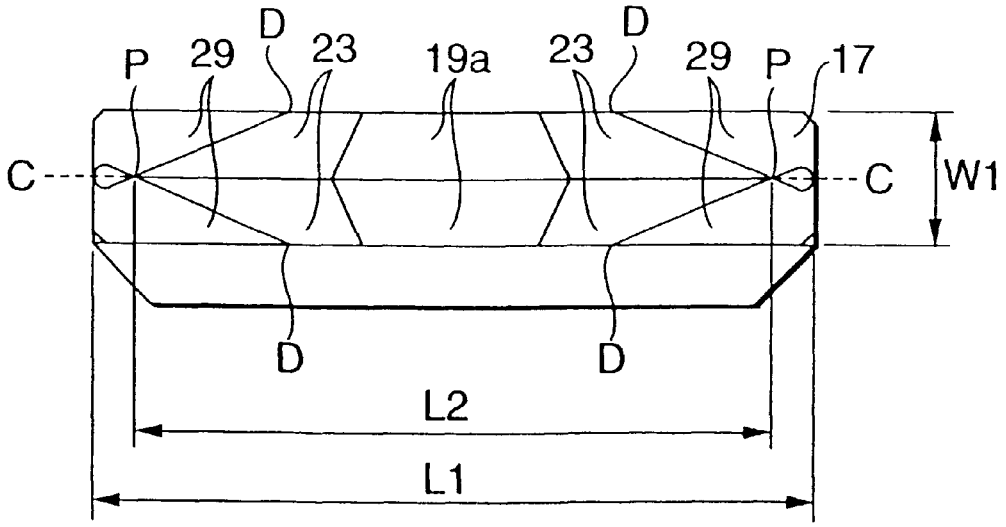
FIG. 3 is a top view of the expansion wedge shown in FIG. 1.

FIGS. 1 through 3 show an expansion wedge for use with a heat exchanger tube according to the first embodiment of the present invention.

Figure 4:
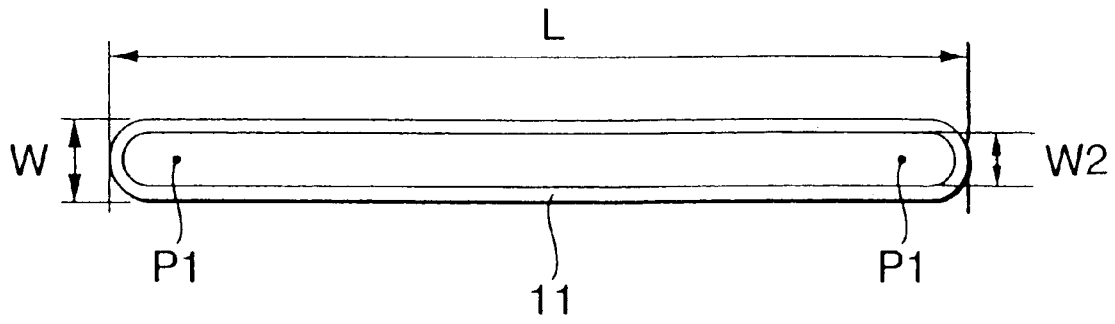
FIG. 4 is a descriptive view showing a tube to be expanded by the expansion wedge shown in FIG. 1.
Figure 5:
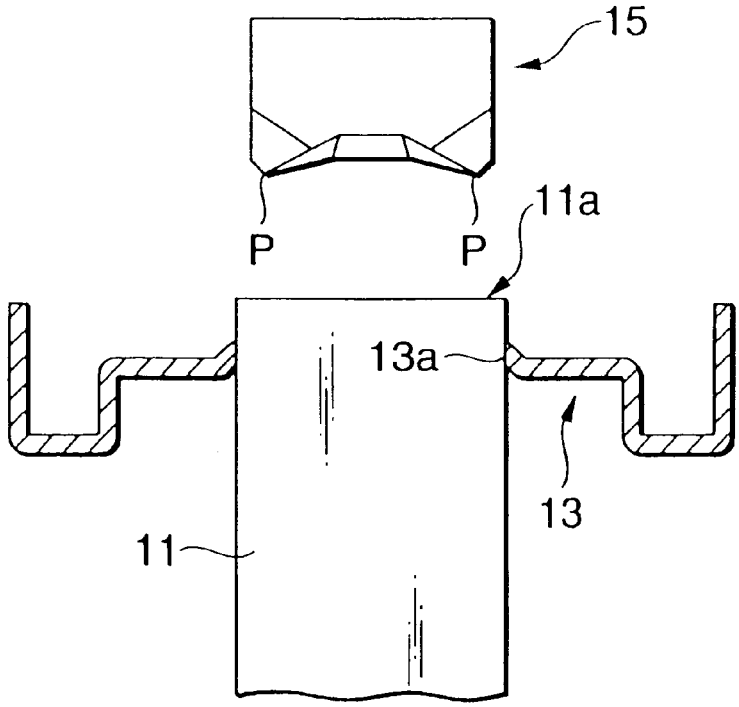
FIG. 5 is a descriptive view showing a method of increasing the cross-sectional width of the tube through use of the expansion wedge shown in FIG. 1.

In the present embodiment, an aluminum tube 11 having a flat cross section such as that shown in FIG. 4 is inserted into a tube hole 13*a* of an aluminum header member 13, as shown in FIG. 5. In this state, an expansion wedge 15 is inserted into the opening 11*a* of the tube 11, thereby expanding the cross-sectional width of the opening 11*a* and bringing the opening 11*a* into close contact with the tube hole 13*a*.

Reference numeral 17 shown in FIGS. 1 through 3 designates a flat expansion wedge body formed from, for example, tool steel.

An expansion section 19 is integrally formed with the expansion wedge body 17 so as to locate between an upper two-dot chain line A (viz., a chain line wherein each dash is separated by two dots) and a lower two-dot chain line A' as shown in FIG. 1. Further, a guide protuberance 21 is integrally formed on either longitudinal side of the expansion section 19 so as to protrude upwardly from the two-dot chain line A.

Figures 6A, 6B, 6C, 6D, 6E:
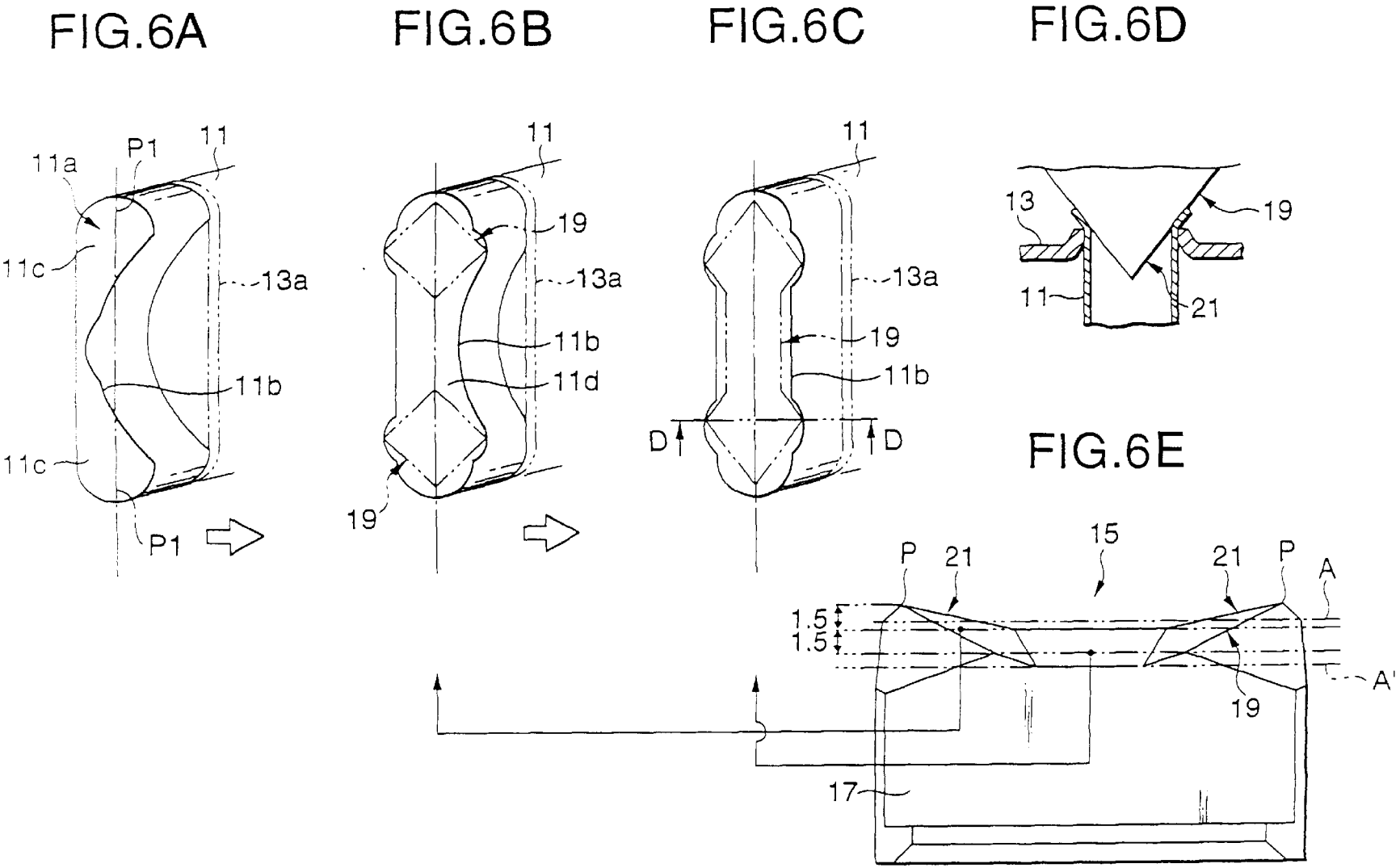
FIGS. 6A–6E show a method of expanding an opening through use of the expansion wedge in a case where a portion of a longitudinal side surface of a tube becomes deformed.

As shown in FIG. 6C, the expansion section 19 is inserted into the opening 11*a* of the tube 11 to a predetermined depth, thus increasing the distance between longitudinal side surfaces 11*b* of the opening 11*a*.

Further, as shown in FIG. 6B, the guide protuberances 21 are inserted into the respective sides of the opening 11*a* of the tube 11 and guide the expansion section 19 into the opening 11*a*, as shown in FIG. 6C.

Further, as shown in FIGS. 2 and 4, provided that the shorter distance between interior surfaces of the tube 11 is taken as W2, the width $W_A$ of a cross section taken along the two-dot chain line A spaced distance $L_A$ from the apex P is set to be identical with W2, as shown in FIG. 2. The guide protuberances 21 are defined between the two-dot chain line A and the apex P.

In the present embodiment, a pair of first inclined faces 19*a* are formed between the guide protuberances 21 and meet along the longitudinal center axis (a dot line C in FIG. 3) of the expansion section 19.

As shown in FIG. 2, an angle θ1 between the pair of first inclined faces 19*a* is set to be about 77°.

The distance between the apexes P of the pair of guide protuberances 21 is set such that the apexes P correspond to points P1 provided inside the tube 11 shown in FIG. 4.

In the present embodiment, the tube 11 shown in FIG. 4 is formed from aluminum material having a thickness of 0.25 mm. The longitudinal length L of the opening 11*a* is set to 25.5 mm, and the width W of the opening 11*a* is set to 1.7 mm.

As shown in FIG. 3, the expansion edge body 17 has a longitudinal length L1 of 24 mm and a thickness W1 of 4.0 mm, and a distance L2 between the apexes P of the pair of guide protuberances 21 is set to 21.3 mm.

A pair of second inclined faces 23 are formed on either side of the expansion section 19 so as to extend from the respective apexes P of the guide protuberances 21 and to be formed integrally with the respective first inclined faces 19*a*. In each pair of second inclined faces 23, the second inclined faces 23 meet along the longitudinal center axis (a dot line C in FIG. 3) of the expansion section 19.

As shown in FIG. 1, an inclined angle θ2 of a ridge line PD hereinafter described is set to about 30°.

As shown in FIG. 1, a third inclined face 27 is also formed so as to extend outward from the respective apex P of the guide protuberance 21.

An inclined angle θ3 of the third inclined face 27 is set to about 43°.

As shown in FIGS. 1 and 3, a pair of fourth inclined faces 29 are formed on one side of each of the guide protuberances 21 so as to continually extend from the pair of second inclined faces 23 of the guide protuberance 21. In each pair of the fourth inclined faces 29, the inclined faces 29 meet along the longitudinal center line (a dot line C in FIG. 3) of the expansion section 19.

In the present embodiment, ridge lines PD are formed so as to extend from each of the apexes P of the guide protuberances 21 toward the longitudinal center of the expansion wedge body 17 as well as to either side of the expansion wedge body 17 in the widthwise direction thereof.

The ridge lines PD come into contact with the interior surfaces of the opening 11*a* of the tube 11, thus expanding the distance between the longitudinal side surfaces 11*b* of the opening 11*a* of the tube 11.

The cross-sectional width of the tube 11 is expanded through use of the previously-described expansion wedge 15 in the following manner.

In the present embodiment, the tube 11 such as that shown in FIG. 4 is inserted into the tube hole 13*a* of the header member 13, as shown in FIG. 5. In this state, the expansion wedge 15 is inserted into the opening 11*a* of the tube 11, thus expanding the cross-sectional width of the opening 11*a* and bringing the opening 11*a* into close contact with the tube hole 13*a*.

In a case where one of the longitudinal side surfaces 11*b* of the opening 11*a* of the tube 11 becomes deformed interiorly, as shown in FIG. 6A, the cross-sectional width of the tube 11 is expanded in the following manner.

First, the expansion wedge 15 is moved toward the tube 11, so that the apex P of the guide protuberance 21 formed on either longitudinal side of the expansion section 19 is inserted into the respective space 11*c* defined in the respective side of the opening 11*a* of the tube 11.

As a result of further insertion of the expansion wedge 15, the pair of ridge lines PD are brought into contact with the interior surfaces of the longitudinal sides of the opening 11*a* of the tube 11, and the distance between the longitudinal sides of the opening 11*a* of the tube 11 in respective sides thereof is expanded. As shown in FIG. 6B, the tube 11 eventually becomes deformed, thus ensuring a space 11*d* which permits smooth insertion of the expansion section 19.

Subsequently, as a result of further insertion of the expansion wedge 15, the expansion section 19 is inserted into the space 11*d*. As shown in FIGS. 6C–6D, the distance between the longitudinal side surfaces 11*b* of the tube 11 is expanded by means of the expansion section 19.

FIG. 6D shows a cross-sectional view taken along the line D while the expansion wedge 15 is inserted into the tube 11, as shown in FIG. 6C.

Further insertion of the expansion wedge 15 into the opening 11*a* results in an increase in the overall distance in the longitudinal direction of the tube 11 between the longitudinal side surfaces 11*b* of the opening 11 of the tube 11. Accordingly, the opening 11*a* is brought into close contact with the tube hole 13*a*.

In the present embodiment, FIG. 6B shows a state in which the guide protuberances 21 of the expansion wedge 15 have been inserted into the tube 11 to a depth of 1.5 mm from the respective apexes P.

FIG. 6C shows a state in which the guide protuberances 21 have been further inserted into the tube 11 to a depth of 1.5 mm from the state of FIG. 6B.

In the present embodiment, the expansion operation is terminated after the expansion wedge 15 has been inserted 0.5 mm further into the tube 11 from the state of FIG. 6C.

In the expansion wedge 15 for use with a heat exchanger of the present embodiment, the expansion section 19 for expanding the distance between the longitudinal side surfaces 11*b* of the tube 11 when being inserted to a predetermined depth into the opening 11*a* of the tube 11 is formed on the expansion wedge body 17. Further, the guide protuberances 21 are protrusively formed on the respective longitudinal sides of the expansion section 19. The guide protuberances 21 are inserted into the spaces 11*c* provided on the respective sides of the opening 11*a* of the tube 11, thereby guiding the expansion section 19 into the opening 11*a*. As a result, the guide protuberances 21 and the expansion section 19 are prevented from colliding with the edge of the tube 11, thus readily and thoroughly preventing collapse of the opening 11*a* of the tube 11.

Figure 7:
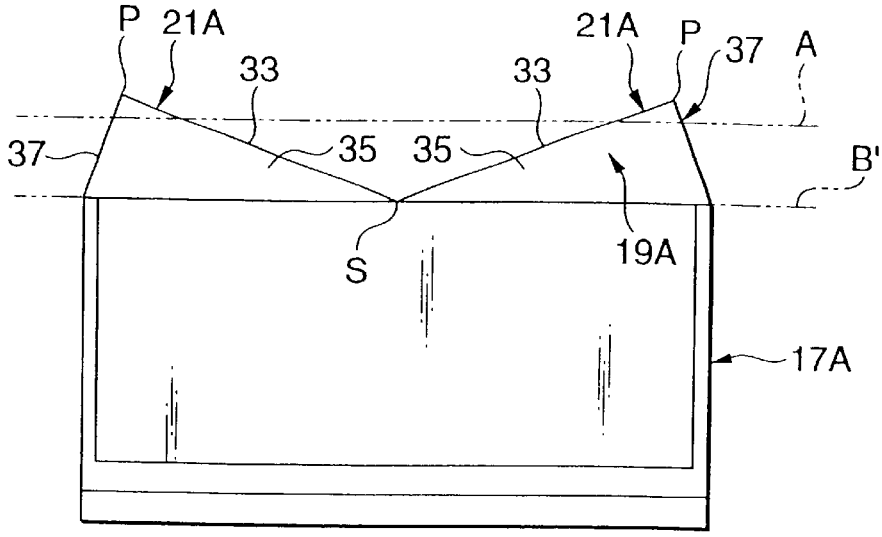
FIG. 7 is a side view showing an expansion wedge for use with a heat exchanger tube according to a second embodiment of the present invention.
Figure 8:
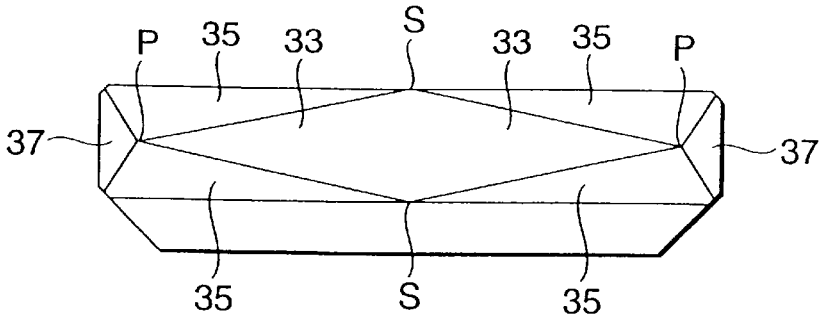
FIG. 8 is a top view of the expansion wedge shown in FIG. 7.
Figure 9:
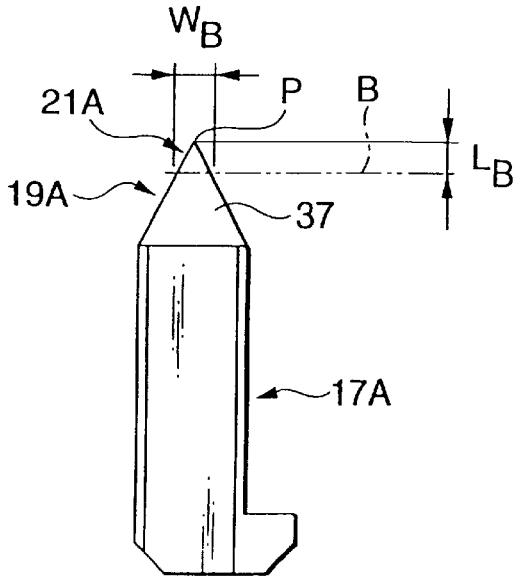
FIG. 9 is a front view of the expansion wedge shown in FIG. 7.

FIGS. 7 through 9 show an expansion wedge for use with a heat exchanger according to a second embodiment of the present invention.

Reference numeral 17A provided in these drawings designates a flat expansion wedge body formed from, example, tool steel.

An expansion section 19A is integrally formed with the expansion wedge body 17A so as to locate between an upper two-dot chain line B and a lower two-dot chain line B' as shown in FIG. 7. Further, a guide protuberance 21A is integrally formed on either longitudinal side of the expansion section 19 so as to protrude upwardly from the two-dot chain line B.

In the present embodiment, first inclined faces 33 are formed so as to extend from the respective apexes P of the guide protuberances 21A and meet at the cross-sectional longitudinal center of the expansion wedge body 17A.

Further, a pair of second inclined faces 35 are formed so as to continually extend from both sides of the first inclined face 33 and meet at the cross-sectional longitudinal center of the expansion wedge body 17A.

As shown in FIG. 7, third inclined faces 37 are formed so as to extend outward and continually from the respective apexes P of the guide protuberances 21A.

More specifically, in the present embodiment, ridge lines PS are formed so as to extend from the respective apexes P of the guide protuberances 31A toward the longitudinal center of the expansion wedge body 17A. Further, the ridge lines PS spread to either side in the widthwise direction of the expansion wedge body 17A.

As a result of the ridge lines PS coming into contact with the interior surfaces of the opening 11*a* of the tube 11, the distance between the longitudinal side surfaces 11*b* of the opening 11*a* of the tube 11 is increased.

As shown in FIG. 4, provided that the shorter diameter between the interior surfaces of the tube 11 is taken as W2, the width $W_B$ of the cross section taken along line the two-dot chain line B spaced from the apex P by distance $L_B$ is set to be identical with W2, and the area defined between the two-chain dot line B and the apex P is taken as the guide protuberance 21A.

In the expansion wedge 17A for use with a heat exchanger of the present embodiment, the expansion section 19A for expanding the distance between the longitudinal side surfaces 11*b* of the tube 11 when inserted to a predetermined depth into the opening 11*a* of the tube 11 is formed on the expansion wedge body 17A. Further, the guide protuberances 21A are protrusively formed on the respective longitudinal sides of the expansion section 19A. The guide protuberances 21A are inserted into the spaces 11*c* provided on the respective sides of the opening 11*a* of the tube 11, thereby guiding the expansion section 19A into the opening 11*a*. As a result, the guide protuberances 21 and the expansion section 19A are prevented from colliding with the edge of the tube 11, thus readily and thoroughly preventing collapse of the opening 11*a* of the tube 11.

Figure 10:
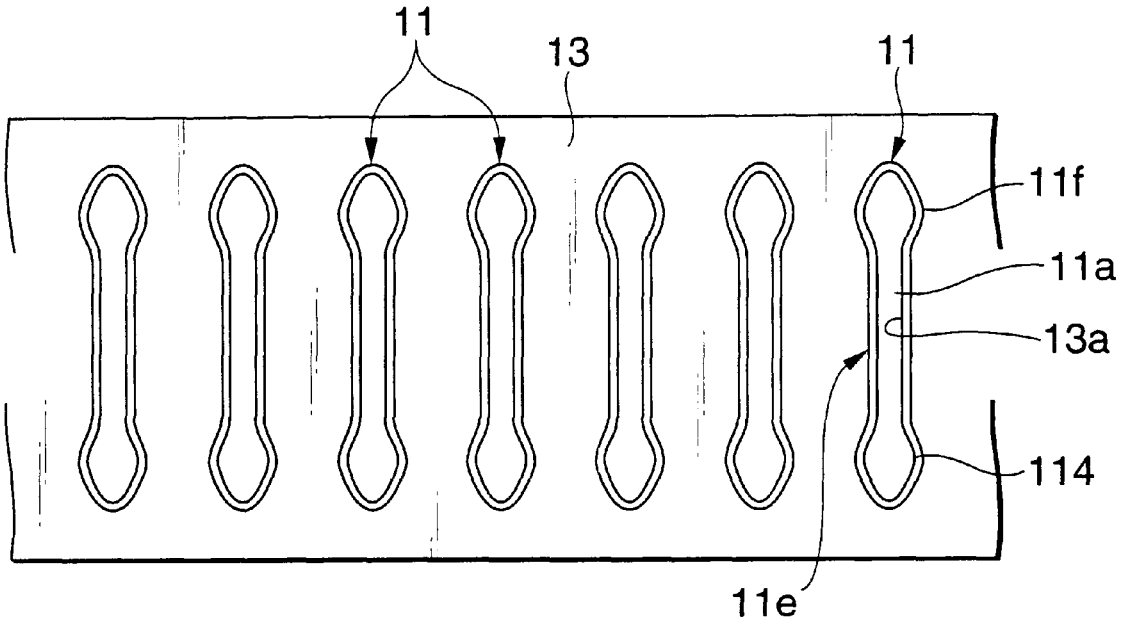
FIG. 10 is a front view showing a structure for mounting a tube to a header member of a heat exchanger according to one embodiment of the present invention.

FIG. 10 shows one example of a structure for mounting a tube to a header member of a heat exchanger of the present invention. In the present example, either longitudinal side of the opening 11*a* of the tube 11 to be inserted into the tube hole 13*a* of the header member 13 is formed so as to have a width greater than that of a center portion 11*e*: specifically, an enlarged section 11*f* is formed in either longitudinal side of the opening 11*a* of the tube 11.

Figure 11:
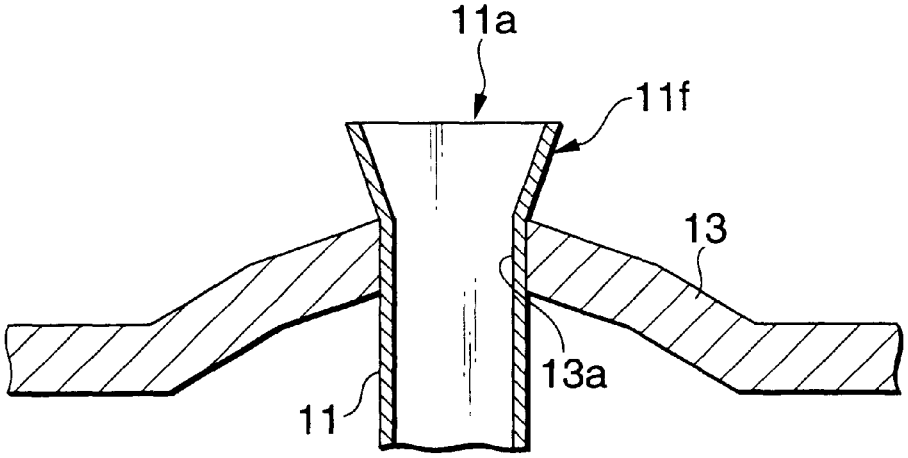
FIG. 11 is a cross-sectional view for showing details of the expansion wedge shown in FIG. 10.

As shown in FIG. 11, the lateral sides of the opening 11*a* of the tube 11 are brought into press contact with the tube hole 13*a* of the header member 13.

The enlarged sections 11*f* are formed in the foregoing manner through use of the expansion wedge of the present invention for use with a heater exchanger tube.

Figure 12:
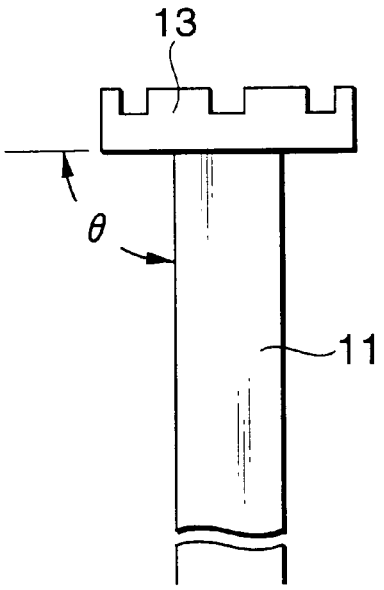
FIG. 12 is a descriptive view showing an angular relationship between the header member and the tube.

The structure for mounting a tube to a header member of a heat exchanger enables fastening of the tube 11 on the header member 13. As shown in FIG. 12, the tubes 11 can be reliably mounted on the header member 13 at an angle θ of 90°.

It has been ascertained that the positional relationship between the header member 13 and the tubes 11 remains sustained even when the heat exchanger has been subjected to cleansing and passed through a drying furnace, a preheating furnace, and a baking furnace after assembly of a core section.

Figure 13:
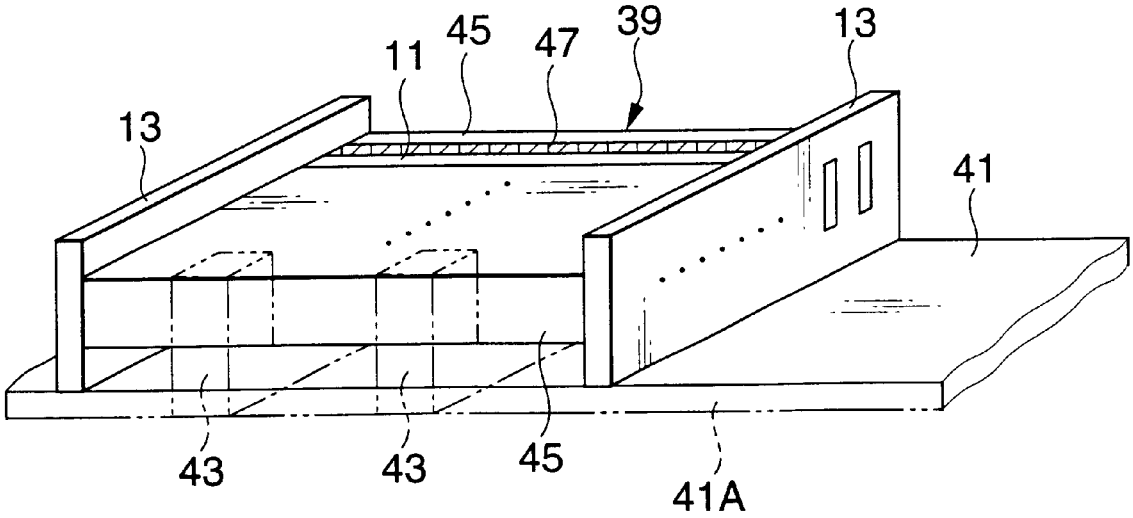
FIG. 13 is a descriptive view showing a state in which a core section is transported.
Figure 14:
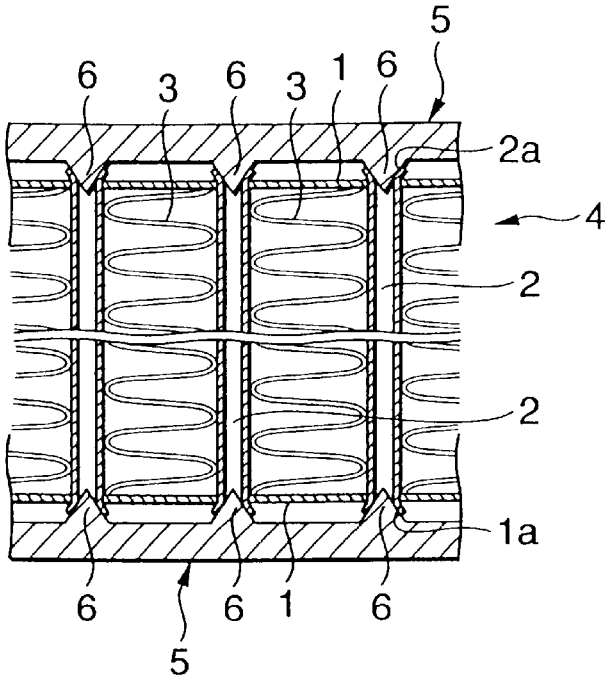
FIG.14 (PRIOR ART)
FIG. 14 is a cross-sectional view showing a known method of expanding a tube.
Figure 15:
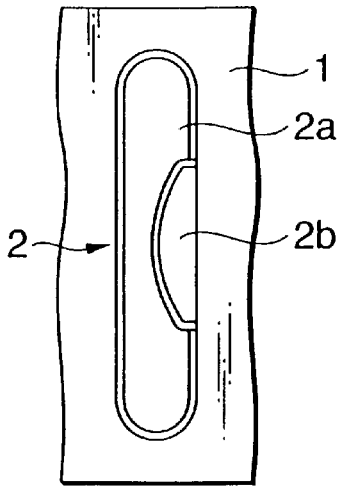
FIG.15 (PRIOR ART)
FIG. 15 is a descriptive view showing a tube having a collapsed opening.
Figure 16:
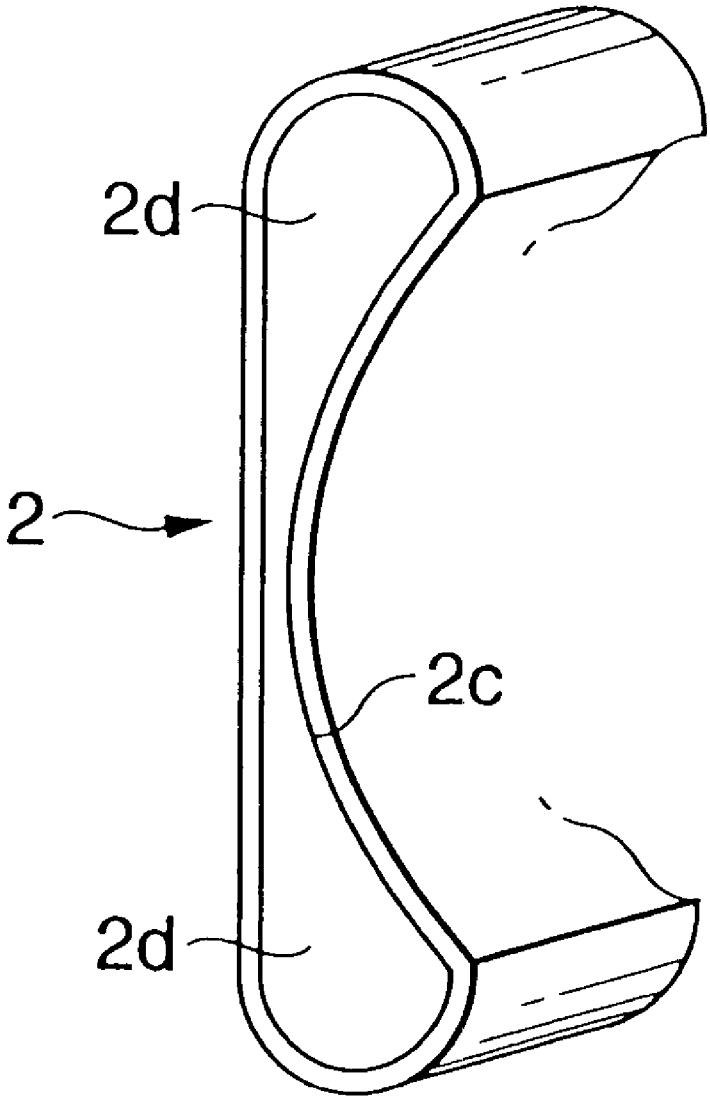
FIG. 16 (PRIOR ART)
FIG. 16 is a descriptive view showing the deformed state of a tube.

The mounting structure of the present example enables reliable maintenance of a positional relationship between the header 13 and the tubes 11. As shown in FIG. 13, when a core section 39 is transported horizontally, the header member 13 can be transported while resting directly on a transport surface 41.

In the existing mounting structure, weak force is applied for retaining the positional relationship between the header member 13 and the tubes 11. For example, there has been a necessity for taking into consideration protection of the header member 13 from an external force, by placing on the core section 39 a binding and baking jig 43 for binding the core section 39 and by transporting the header member 13 while levitating the same from a transport surface 41A by means of the binding and baking jig 43. In contrast, the mounting structure of the present example obviates a necessity for levitating the header member 13, thus facilitating transportation of the core section 39. Further, the mounting structure reduces the heat capacity of the binding and baking jig 43, thus enabling efficient baking.

FIG. 13 schematically shows the core section 39. Reference numeral 45 designates a reinforcement member, and reference numeral 47 designates a corrugated fin.

The previous embodiments have described a case where the expansion wedge 15 is moved and inserted into the opening 11*a* of the tube 11 after the tube 11 has been inserted into the header member 13. However, the present invention is not limited to such embodiments. For instance, after the expansion wedge 15 has been inserted into the tube hole 13*a* of the header member 13 to a predetermined depth, the tube 11 may be moved and the tube hole 13*a* may be expanded simultaneous with insertion of the tube 11 into the tube hole 13*a*.

Although the previous embodiments have described an example in which the present invention is applied to a radiator, the present invention is not limited to such embodiments. For instance, the present invention can be broadly applied to a heat exchanger, for example, a condenser.

The previous embodiments have described a case where a single wedge is formed in the expansion wedge body 17 and a plurality of expansion wedge bodies 17 are incorporated into an assembly machine. However, the present invention is not limited to such embodiments. For example, the expansion wedge body 17 may be formed from long plate material, and wedges may be integrally formed on the plate material at intervals.

As has been described above, the expansion wedge for use with a heat exchanger tube comprises an expansion wedge body on which there is formed the expansion section for expanding the distance between longitudinal side surfaces of the tube when being inserted to a predetermined depth into the opening of the tube, and guide protuberances which are protrusively formed on the respective longitudinal sides of the expansion section and which are inserted into the spaces provided on the respective sides of the opening of the tube, thereby guiding the expansion section into the opening. As a result, the guide protuberances and the expansion section are prevented from colliding with the edge of the tube, thereby readily and thoroughly preventing collapse of an opening of a tube.

In the structure for mounting a tube to a header member of a heat exchanger, either longitudinal side of the opening of the tube is made so as to have a width greater than that of a center portion, and the opening is brought into press-contact with the tube hole of the header member. Accordingly, the tube can be firmly attached to the header member.

Although the invention has been described in its preferred form with a certain degree of particularity, it is understood that the present disclosure of the preferred form can be arrangement of parts without departing from the spirit and the scope of the invention as hereinafter claimed.

What is claimed is:

1. A structure for mounting a flat tube to a header member of a heat exchanger wherein the header member has a tube hole; and the tube is disposed through the tube hole so that a portion of the tube projects out of and beyond the header member, at least longitudinally opposed sides of the portion of the tube being outwardly expanded via insertion of an expansion wedge to establish contact between the tube and the tube hole, and wherein the tube portion as expanded by the expansion wedge has a varied width.

2. A structure for mounting a flat tube to a header member of a heat exchanger wherein the header member has a tube hole and the tube is disposed through the tube hole so that a first portion of the tube projects out into a space beyond a surface of the header member, wherein the first portion of the tube is outwardly flared in its entirety via the insertion of an expansion wedge to expand and force longitudinally opposed sides of a second portion of the tube, which is within the tube hole and contiguous with the first portion of the tube which is outwardly flared, into a press-fit contact with the tube hole, and wherein the first portion of the tube as outwardly flared by the expansion wedge has a varied width.

3. A structure for mounting a flat tube to a header member of a heat exchanger, comprising:

a tube hole formed in the header member; and an opening of the flat tube being inserted into the tube hole, the opening of the flat tube having longitudinally opposed end sections and a center section which is located between the end sections, wherein the opening of the flat tube is expanded in such a manner that both longitudinally opposed end sections of the opening of the flat tube have opposed sides which have a width greater than any widths of opposed sides of the center portion of the opening of the flat tube, so that at least the opposed sides of the end sections of the opening of the flat tube are brought into press-contact with the header member around the tube hole.

4. A structure as set forth in claim 3, wherein the opening of the flat tube is outwardly flared at all portions thereof.

5. A structure as set forth in claim 4, wherein the outwardly flared portions of the end sections of the flat tube have a width wider than any other portion of the opening of the tube.

6. A structure as set forth in claim 4, wherein the outwardly flared portions of the opening of the flat tube have a width greater than any portion of the tube hole.

7. A structure as set forth in claim 4, wherein the outwardly flared portions of the opening of the flat tube define a funneled section which has a predetermined angle with respect to a longitudinal axis of the tube.

* * * * *